US008807688B2

(12) United States Patent
Sano

(10) Patent No.: US 8,807,688 B2
(45) Date of Patent: Aug. 19, 2014

(54) RECORDING SYSTEMS AND ADDITIONAL OUTPUT STACKERS USED THEREWITH

(75) Inventor: Toshiyuki Sano, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 379 days.

(21) Appl. No.: 13/431,586

(22) Filed: Mar. 27, 2012

(65) Prior Publication Data

US 2013/0083112 A1 Apr. 4, 2013

(30) Foreign Application Priority Data

Sep. 30, 2011 (JP) ..... 2011-216604

(51) Int. Cl.
*B41J 29/38* (2006.01)
*B41J 13/00* (2006.01)
*B41J 11/00* (2006.01)

(52) U.S. Cl.
CPC ..... *B41J 29/38* (2013.01); *B41J 13/0036* (2013.01); *B41J 11/006* (2013.01)
USPC ..... 347/16

(58) Field of Classification Search
None
See application file for complete search history.

(56) References Cited

U.S. PATENT DOCUMENTS 6,295,081 B1 * 9/2001 Kashima et al. ..... 347/262
2010/0264574 A1 * 10/2010 Tyson et al. ..... 271/3.14

FOREIGN PATENT DOCUMENTS

JP H07-010344 A 1/1995

* cited by examiner

*Primary Examiner* — Geoffrey Mruk
*Assistant Examiner* — Bradley Thies
(74) *Attorney, Agent, or Firm* — Baker Botts L.L.P.

(57) ABSTRACT

An image recording apparatus includes an apparatus-side transport destination switching unit that may switch selectively the transport destination of paper on which an image has been recorded between an apparatus-side output tray and an additional output stacker. The additional output stacker includes an additional output tray that may be configured to receive paper; a stacker-side transport unit that is configured to transport paper, which has been transported from the image recording apparatus, to the additional output tray; and a stacker-side controller that controls the transport destination switching unit of the image recording apparatus. When a paper jam is detected on the stacker-side transport unit, the additional unit controller controls the apparatus-side transport destination switching unit, so that the transport destination of the paper may be switched from the additional output tray to the apparatus-side output tray.

7 Claims, 6 Drawing Sheets

RECORDING SYSTEMS AND ADDITIONAL OUTPUT STACKERS USED THEREWITH

CROSS REFERENCE TO RELATED APPLICATION

This application claims priority from Japanese Patent Application No. 2011-216604, filed on Sep. 30, 2011, which is incorporated herein by reference.

BACKGROUND OF THE INVENTION

1. Field of the Invention

The invention relates to recording systems and paper output stackers used with such recording systems.

2. Description of Related Art

A known recording unit has a plurality of paper output trays. Such recording units are structured, so that, even when an error (i.e., a tray full error) occurs in a paper output tray during use, the printing unit continues printing by outputting paper to another paper output tray.

SUMMARY OF THE INVENTION

Some recording systems may be structured, so that an output stacker may be attached optionally to an image recording apparatus in addition to an apparatus-side output tray. With such recording systems, each image recording apparatus and additional output stacker usually has a controller configured to enable communication between them. An apparatus-side controller may be provided in the image recording apparatus to carry out a process that, for example, switches the transport destination of a recording medium, on which an image was recorded, between the apparatus-side output tray and the additional output stacker. Further, a stacker-side controller may be provided in the additional output stacker to, for example, detect a recording medium jam generated in the additional output stacker.

When a recording medium jam occurs in the additional output stacker, the stacker-side controller may detect the jam and may send detection data to the image recording apparatus controller. Upon receipt of the detection data, the image recording apparatus controller may carry out the process to switch the transport destination of the recording medium, so that the recording medium may be transported to the apparatus-side output tray, rather than the additional output stacker. When the time from when the recording medium jam occurs in the additional output stacker until the transport destination of the recording medium is switched to the apparatus-side output tray is prolonged, however, the recording medium jam in the additional output stacker spreads from the additional output stacker throughout the recording system. Accordingly, there is a need in the art for a recording system with an additional output stacker that prevents a recording medium jam from spreading from the additional output stacker.

To address at least the foregoing problems, the recording systems disclosed herein comprise an image recording apparatus and an additional output stacker attached. The image recording apparatus comprises an apparatus-side transport unit configured to transport a recording medium; an image recording unit configured to record an image on the recording medium according to image data; an apparatus-side output tray configured to receive the recording medium; a transport destination switching unit configured to switch selectively a transport destination of the recording medium between the apparatus-side output tray and the additional output stacker, such that the recording medium on which the image has been recorded by the image recording unit is directed either to the apparatus-side output tray or to the additional output stacker; and an apparatus-side controller configured to control the apparatus-side transport unit, the image recording unit, and the transport destination switching unit. The additional output stacker is configured to attach to the image recording apparatus and comprises an additional output tray configured to receive the recording medium; a stacker-side transport unit configured to transport the recording medium to the additional output tray when the recording medium is directed to the additional output stacker by the transport destination switching unit; a jam detecting unit configured to detect a recording medium jam generated in the stacker-side transport unit; and a stacker-side controller configured to control the transport destination switching unit of the image recording apparatus, so that, when the jam detecting unit detects the recording medium jam, the transport destination switching unit switches the transport destination of the recording medium from the additional output stacker to the apparatus-side output tray.

The additional output stacker disclosed herein is configured to be attached to an image recording apparatus comprising an apparatus-side output tray and a transport destination switching unit configured to switch selectively a transport destination of a recording medium between the apparatus-side output tray and a location other than the apparatus-side output tray. The additional output stacker comprising an additional output tray configured to receive recording media at the location other than the apparatus-side output tray; a transport unit configured to transport the recording medium to the additional output tray, when the transport destination switching unit has set the transport destination of the recording medium to the location other than the apparatus-side output tray; a jam detecting unit configured to detect a recording medium jam generated on the transport unit; and a controller configured to control the transport destination switching unit of the image recording apparatus, so that, when the jam detecting unit detects the recording medium jam, the transport destination of the recording medium is switched from the location other than the apparatus-side output tray to the apparatus-side output tray.

Because the structures of the recording systems and the additional output stackers disclosed herein enable the stacker-side controller to control the transport destination switching unit of the image recording apparatus directly, the processing time taken between when a recording medium jam occurs in the additional output stacker until the transport destination of the recording medium was switched to the apparatus-side output tray may be reduced. As a result, it is possible to prevent the recording medium jam caused in the additional output stacker from spreading.

Other objects, features, and advantages will be apparent to persons of ordinary skill in the art from the following detailed description of embodiments of the invention and the accompanying drawings.

BRIEF DESCRIPTION OF THE DRAWINGS

For a more complete understanding of the invention, needs satisfied thereby, and the objects, features, and advantages thereof, reference now is made to the following descriptions taken in connection with the accompanying drawings.

DETAILED DESCRIPTION OF EMBODIMENTS OF THE INVENTION

Figure 1:
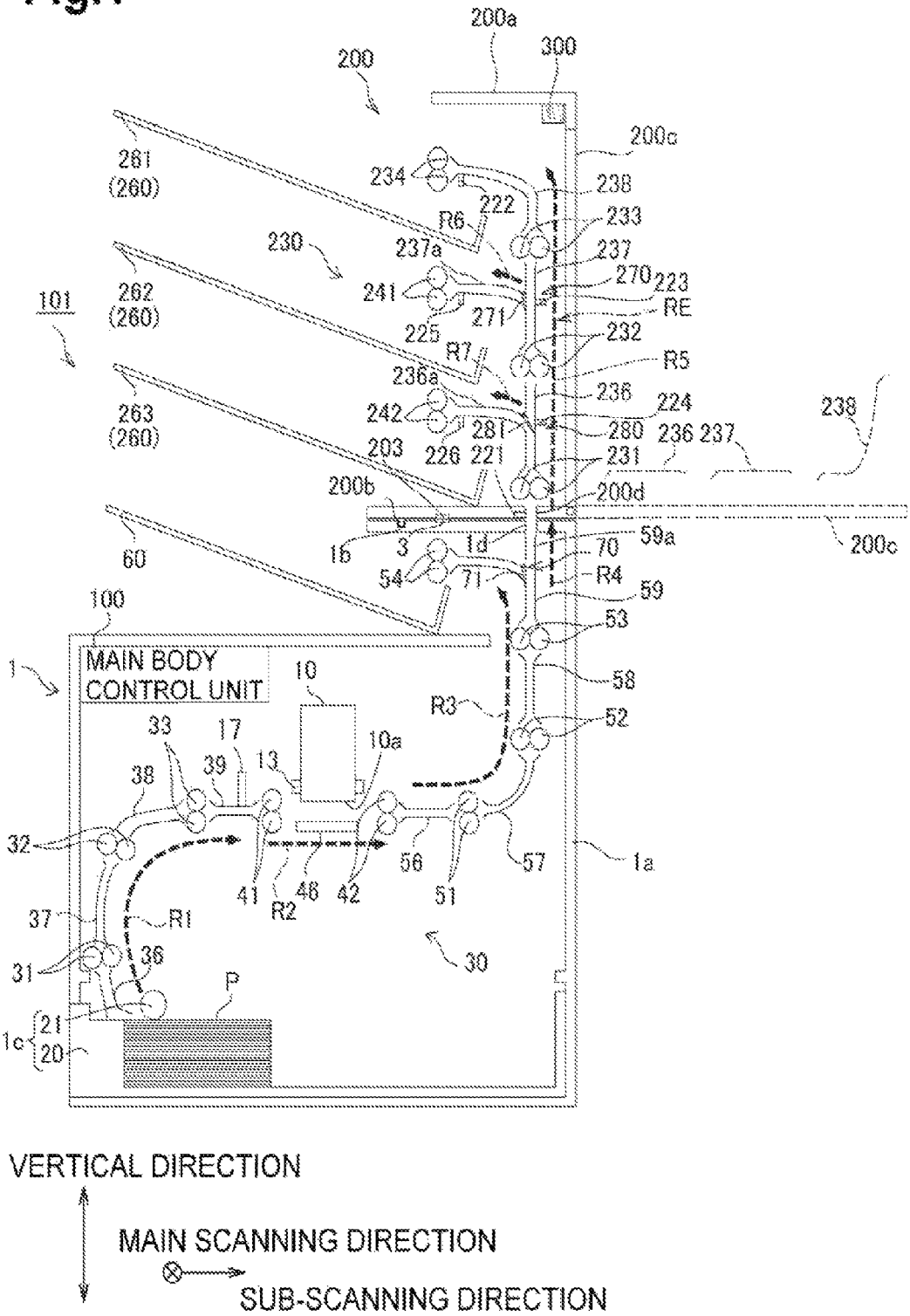
FIG. 1 is a schematic, side view that depicts the mechanical structure of a printer according to an embodiment of the present invention.

Embodiments of the invention now are described in detail with reference to the accompanying drawings, wherein like reference numerals are used for like corresponding parts in the various drawings.

First, the structure of printer 101 (e.g., a recording system) is described with reference to FIGS. 1 and 2. As depicted in FIG. 1, printer 101 may comprise a main body 1 (e.g., an image recording apparatus) that may be configured to record (e.g., to form) an image on paper P, and an additional paper output unit 200 (e.g., an additional output stacker) that may be attached removably to main body 1.

1. Mechanical Structure of Main Body

Main body 1 may comprise a cabinet 1*a* that may be formed in a rectangular parallelepiped shape. A paper output opening 1*d* may be formed in the top plate of cabinet 1*a*, and a main body paper output tray 60 (e.g., an apparatus-side output tray), which may be configured to receive paper P, may be provided on the top plate of cabinet 1*a*, wherein paper P may be a recording medium. A transport path along which paper P may be transported may be formed from paper supply unit 1*c* (described below) toward main body paper output tray 60 in an internal space of printer 101, as defined by cabinet 1*a*.

Transport mechanism 30 (e.g., an apparatus-side transport unit), ink jet head 10 (e.g., an image recording unit; referred to below as "head"), paper supply unit 1*c*, main body control unit 100 (e.g., an apparatus-side controller), touch panel 80 (e.g., FIG. 3B), and the like may be disposed in the internal space of printer 101. Transport mechanism 30 may be configured to form transport paths of paper P; ink jet heat 10 may be configured to record an image on paper P while paper P is being transported by transport mechanism 30; paper supply unit 1*c* may be configured to supply paper P to transport mechanism 30; and main body control unit 100 may be configured to control the operation of the components of main body 1.

Head 10 may be a line head that may be formed in a substantially rectangular, parallelepiped shape elongated in a main scanning direction. A lower surface of head 10 may be expelling surface 10*a*, which comprises many expelling openings. Head 10 may be supported by cabinet 1*a* via head holder 13. Head holder 13 may hold head 10, so that a predetermined clearance suitable for image recording may be formed between expelling surface 10*a* and platen 46 (described below).

The transport paths formed by transport mechanism 30 may comprise main body transport paths R1, R2, and R3, which may facilitate normal transport, and main body transport path R4, which may be connected to additional transport path RE (described below) in additional paper output unit 200, when additional paper output unit 200 is attached to main body 1.

Main body transport path R1 may extend from paper supply unit 1*c* to a recording position (e.g., a position that faces expelling surface 10*a*) and may comprise feed rollers 31, 32, and 33 and guides 36, 37, 38, and 39. Main body transport path R2 may pass through the recording position in head 10 and may comprise feed rollers 41 and 42 and platen 46. Platen may face head 10. Main body transport path R3 may extend from the recording position to main body paper output tray 60 and may comprise feed rollers 51, 52, 53, and 54 and guides 56, 57, 58, and 59.

Main body transport path 84 may branch from an intermediate point on main body transport path R3 and may extend to paper output opening 1*d*. Main body transport path R4 may comprise a branch guide 59*a* that may branch from guide 59 to paper output opening 1*d*. Feed rollers 31-33, 41, 42, and 51-54 each may comprise a pair of roller members oppositely disposed so as to tightly hold paper P and apply a transport force to paper P, such that paper P may be transported in the transport direction. Each of guides 36-39 and 56-59 may be formed by a pair of oppositely disposed guide surfaces that may be supported by cabinet 1*a*.

Main body transport destination switching mechanism 70 (e.g., a transport destination switching unit) may be provided at a branch point between main body transport path R3 and main body transport path R4. Main body transport destination switching mechanism 70 may be operable to switch selectively the transport destination of paper P, on which an image was recorded, between main body paper output tray 60 and additional paper output unit 200. Main body transport destination switching mechanism 70 may comprise a swinging member 71 that may be configured to swing between a first position (as depicted in FIG. 2) and a second position (as depicted in FIG. 1) at which main body transport path R3 and main body transport path R4 intersect. Main body transport destination switching mechanism 70 also may comprise a main body transport destination switching motor 72 (e.g., FIG. 3B) that may be configured to drive swinging member 71. Under the control of main body control unit 100 or additional unit controlling unit 300 (e.g., a stacker-side controller), swinging member 71 may be placed at the first position, when paper P is transported to main body paper output tray 60, and at the second position, when paper P is transported to additional paper output unit 200, by driving the main body transport destination switching motor 72.

Paper supply unit 1*c* may comprise paper supply tray 20 and paper supply roller 21. Paper supply tray 20 may be attached removably to cabinet 1*a* in a sub-scanning direction (e.g., a direction orthogonal to the main scanning direction and the vertical direction). Further, paper supply tray 20 may be a box, the top of which may be open, such that paper supply tray 20 is configured to store a plurality of sheets of paper P. Paper supply roller 21 may feed out an uppermost sheet of paper P in paper supply tray 20 to main body transport path R1. In the embodiment depicted in FIGS. 1 and 2, head 10 may form the image recording unit.

In response to recording commands received from an external device (e.g., a personal computer ("PC") connected to printer 101), main body control unit 100 may perform image recoding operations, such as transporting paper P and expelling ink, in synchronization with the transport of paper P, so that an image may be recorded on paper P. For example, paper P may be fed out of paper supply tray 20 and transported along main body transport paths R1 and R2 by the transport operation of main body control unit 100. When paper P passes a recording position in the sub-scanning direction, which may be immediately below head 10, head 10 may be driven by main body control unit 100 to expel ink from the expelling openings of expelling surface 10*a* toward paper P, while paper P is supported on platen 46, thereby recording a desired image on paper P. Such an ink expelling operation of main body control unit 100 may be carried out in response to a detection signal from a paper sensor 17. Paper P then may be transported along main body transport path R3, and further may be transported to main body paper output tray 60 when swinging member 71 of main body transport destination switching mechanism 70 is positioned at the first point, or to additional paper output unit 200, when swinging member 71 is positioned at the second position.

Positioning hole 1*b*, which may be used to position additional paper output unit 200, so that additional paper output unit 200 may be attached to main body 1, may be formed in an upper surface of the top plate of cabinet 1*a*. Main body connector 3 also may be provided on the upper surface of the top plate of cabinet 1*a* to provide an electrical connection between main body control unit 100 and additional unit controlling unit 300 (described below), which may be provided in additional paper output unit 200. Thus, when additional connector 203 (described below), which may be provided on additional paper output unit 200, is connected to main body connector 3, electrical communication becomes possible between main body control unit 100 and additional unit controlling unit 300. Main body connector 3 may be connected electrically to main body transport destination switching motor 72 of main body transport destination switching mechanism 70, such that, when additional connector 203 is connected to main body connector 3, additional unit controlling unit 300 may control main body transport destination switching motor 72 directly.

2. Mechanical Structure of Additional Paper Output Unit

Next, the mechanical structure of additional paper output unit 200 is described. Additional paper output unit 200 may comprise an additional paper output cabinet 200*a*, as depicted in FIG. 1. Additional paper output cabinet 200*a* may comprise three (3) additional paper output trays 260 (e.g., first additional paper output tray 261, second additional paper output tray 262, and third additional paper output tray 263), additional transport mechanism 230 (e.g., a stacker-side transport unit), and additional unit controlling unit 300 (e.g., a stacker-side controller). Each of the three (3) additional paper output trays 260 may be spaced vertically and configured to store paper P; additional transport mechanism 230 may be configured to form additional transport path RE for paper P; and additional unit controlling unit 300 may be configured to control the operation of additional paper output unit 200. A lower plate of additional paper output cabinet 200*a* may comprise a paper supply opening 200*d* through which paper P may pass, when transported from main body 1.

Additional transport path RE, which may be formed in additional transport mechanism 230, may comprise main additional transport path R5 and branch additional transport paths R6 and R7, which may branch from intermediate points on main additional transport path R5.

Main additional transport path R5 may extend from paper supply opening 200*d* to first additional paper output tray 261, which may be located uppermost in the vertical direction in additional paper output unit 200. Main additional transport path R5 may be configured to guide paper P to first additional paper output tray 261 when paper P is transported from main body 1. Main additional transport path R5 may be formed by feed rollers 231, 232, 233, and 234 and guides 236, 237, and 238. A stacker-side main transport section may be formed with main additional transport path R5, feed rollers 231-234, and guides 236-238.

Branch additional transport path R6 may branch from an intermediate point on main additional transport path R5 and may extend to second additional paper output tray 262. Branch additional transport path R6 may be configured to guide paper P to second additional paper output tray 262. Branch additional transport path R6 may be formed by feed roller 241 and branch guide 237*a*, which may branch from guide 237.

Branch additional transport path R7 may branch from main additional transport path R5 at a point upstream of the branch point between main additional transport path R5 and branch additional transport path R6 in the transport direction, and may extend to third additional paper output tray 263. Branch additional transport path R7 may be configured to guide paper P to third additional paper output tray 263. Branch additional transport path R7 may be formed by feed roller 242 and branch guide 236*a*, which may branch from guide 236. Feed rollers 231-234, 241, and 242 each may comprise a pair of roller members oppositely disposed so as to tightly hold paper P and apply a transport force to paper P, such that paper P may be transported in the transport direction. Guides 236-238 may each be formed by a pair of oppositely disposed guide surfaces. In each pair of guide surfaces of each of guides 236-238, additional paper output cabinet 200*a* may support the guide surface on the left side, as depicted in FIGS. 1 and 2. A stacker-side branch transport section may be formed with branch additional transport paths R6 and R7, branch guides 236*a* and 237*a*, and feed rollers 241 and 242.

The side wall of additional paper output cabinet 200*a* may comprise an opening, in which door 200*c* may be provided. Door 200*c* may be configured to open with the horizontal axis of door 200*c*, along the main scanning direction, acting as a fulcrum. In each pair of surfaces of each of guides 236-238, door 200*c* may support the guide surface on the right side, as depicted in FIGS. 1 and 2. When paper P jams on additional transport path RE, that structure enables a user to open door 200*c* and remove the jammed paper P (e.g., to clear a paper jam).

Additional tray-side transport destination switching mechanisms 270 and 280, which may be substantially the same as main body transport destination switching mechanism 70 (described above), may be provided, respectively, at the branch point between main additional transport path R5 and branch additional transport path R6 and at the branch point between main additional transport path R5 and branch additional transport path R7. Additional tray-side transport destination switching mechanism 270 may comprise swinging member 271, which may be configured to swing between a first position (as depicted in FIG. 1) and a second position (as depicted in FIG. 2). In the first position, main branch additional transport path R6 may be closed off from additional transport path R5, and in the second position, main additional transport path R5 and branch additional transport path R6 may be placed in communication with one another. Swinging member 271 also may comprise additional transport destination switching motor 272 (e.g., FIG. 3A), which may be configured to drive swinging member 271. Under the control of additional unit controlling unit 300, swinging member 271 may be placed at the first position, when paper P is transported to first additional paper output tray 261, and at the second position, when paper P is transported to second additional paper output tray 262, by driving additional transport destination switching motor 272.

Figure 2:
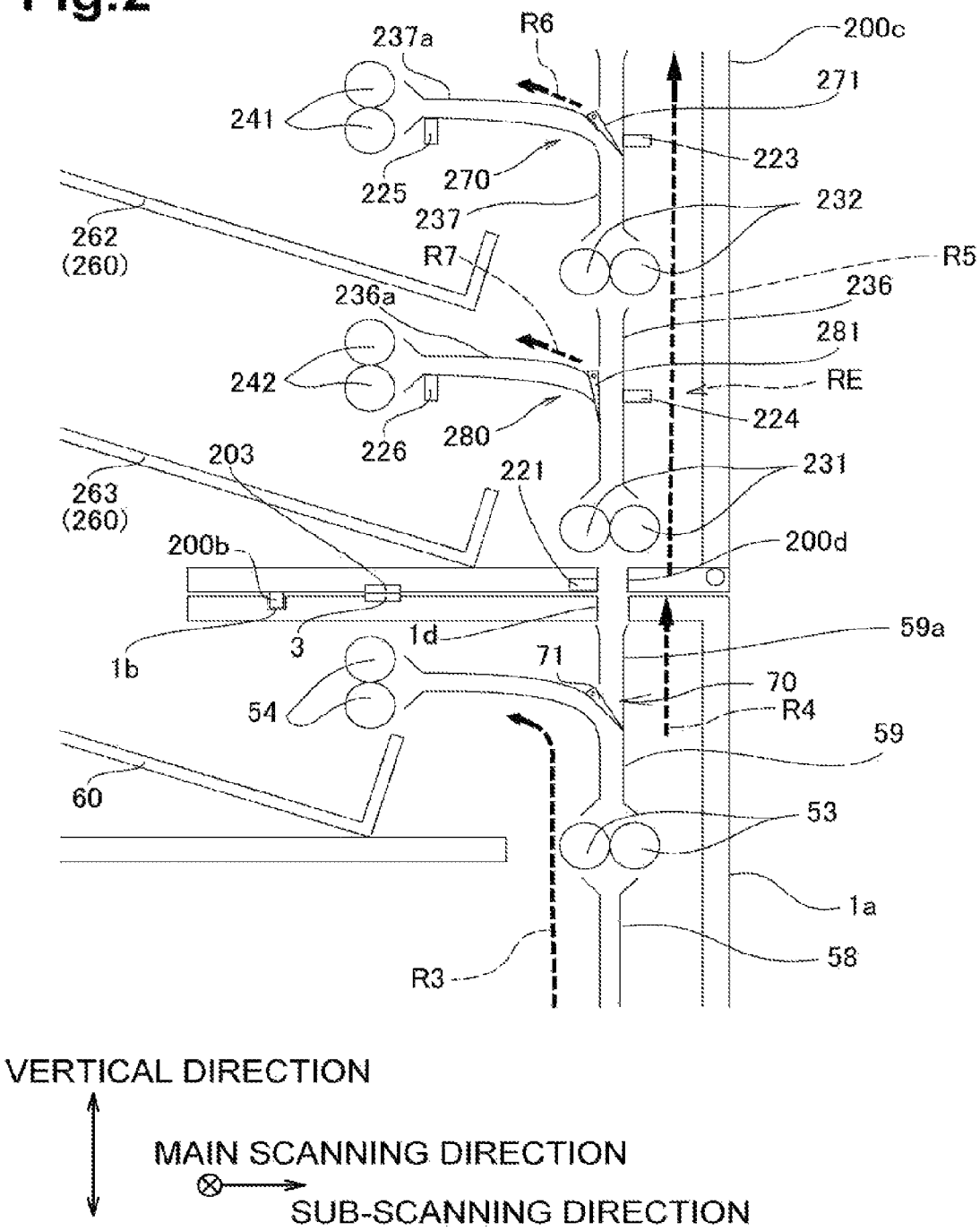
FIG. 2 is a partial, side view in the vicinity of the main body transport destination switching mechanism depicted in FIG. 1.

Additional tray-side transport destination switching mechanism 280 may comprise swinging member 281, which may be configured to swing between a first position (as depicted in FIG. 2) and a second position (as depicted in FIG. 1). In the first position, branch additional transport path R7 may be closed off from main additional transport path R5, and, in the second position, main additional transport path R5 and branch additional transport path R7 may be placed in communication with one another. Additional tray-side transport destination switching mechanism 280 also may comprise an additional transport destination switching motor 282 (e.g., FIG. 3A), which drives swinging member 281. Under the control of additional unit controlling unit 300, swinging member 281 may be placed at the first position when paper P is transported to first additional paper output tray 261 or second additional paper output tray 262 and at the second position when paper P is transported to third additional paper output tray 263 by driving additional transport destination switching motor 282.

Paper detecting sensors 221, 222, 223, and 224 may be provided on main additional transport path R5, so that their detecting surfaces may face paper P as paper P passes through main additional transport path R5. Paper detecting sensor 221 may be disposed at the upstream end of main additional transport path R5 in the transport direction (e.g., at paper supply opening 200*d*); paper detecting sensor 222 may be disposed at the downstream end of main additional transport path R5 in the transport direction (e.g., at the downstream end of guide 238 in the transport direction); paper detecting sensor 223 may be disposed at the branch point at which branch additional transport path R6 branches from main additional transport path R5 (e.g., at tray-side transport destination switching mechanism 270); and paper detecting sensor 224 may be disposed at the branch point at which branch additional transport path R7 branches from main additional transport path R5 (e.g., at tray-side transport destination switching mechanism 280).

Paper detecting sensors 221-224 detect the front edge and rear edge of paper P and output a detection result to additional unit controlling unit 300 as a paper detection signal as paper P passes through main additional transport path R5. When any of paper detecting sensors 221-224 does not detect the rear edge of paper P within a predetermined time after that paper detecting sensor 221, 222, 223, or 224 detected the front edge of paper P (referred to herein as "does not detect the rear edge of paper P"), additional unit controlling unit 300 may determine that paper P jammed in main additional transport path R5 (a jam of paper P is referred to herein as a "paper jam"). The predetermined time may be obtained by dividing the distance between the front edge and rear edge of paper P (e.g., the width of paper P related to the transport direction) by the transport speed of paper P and adding the result to a time equal to a transport error (described below).

Paper detecting sensor 225 may be provided at the downstream end of branch additional transport path R6 in the transport direction (e.g., at the downstream end of branch guide 237*a* in the transport direction), so that its detecting surface may face paper P as paper P passes through branch additional transport path R6. When paper detecting sensor 225 does not detect the rear edge of paper P, additional unit controlling unit 300 may determine that a paper jam occurred on branch additional transport path R6 (e.g., in branch guide 237*a*).

A paper detecting sensor 226 also may be provided at the downstream end of branch additional transport path R7 in the transport direction (e.g., at the downstream end of branch guide 236*a* in the transport direction), so that its detecting surface may face paper P as paper P passes through branch additional transport path R7. When paper detecting sensor 226 does not detect the rear edge of paper P, additional unit controlling unit 300 may determine that a paper jam occurred on branch additional transport path R7 (e.g., in branch guide 236*a*).

A positioning pin 200*b* corresponding to positioning hate 1*b* in main body 1 may be formed on the lower surface of the bottom plate of additional paper output cabinet 200*a*. Additional connector 203 may be connectable to main body connector 3 of main body 1 and also may be provided on the lower surface of the bottom plate of additional paper output cabinet 200*a*. Additional connector 203 may be connected electrically to additional unit controlling unit 300, and additional unit controlling unit 300 may be connected electrically to main body transport destination switching motor 72. When positioning pin 200*b* is inserted into positioning hole 1*b*, additional paper output unit 200 may be attached to main body 1, and body connector 3 may connected electrically to additional connector 203, such that main body control unit 100 and additional unit controlling unit 300 may be connected electrically, so that electrical communication becomes possible therebetween. When positioning pin 200*b* is inserted into positioning hole 1*b*, main body transport path R4 and main additional transport path R5 may be mutually connected.

3. Electric Structure of Main Body

Figure 3A:
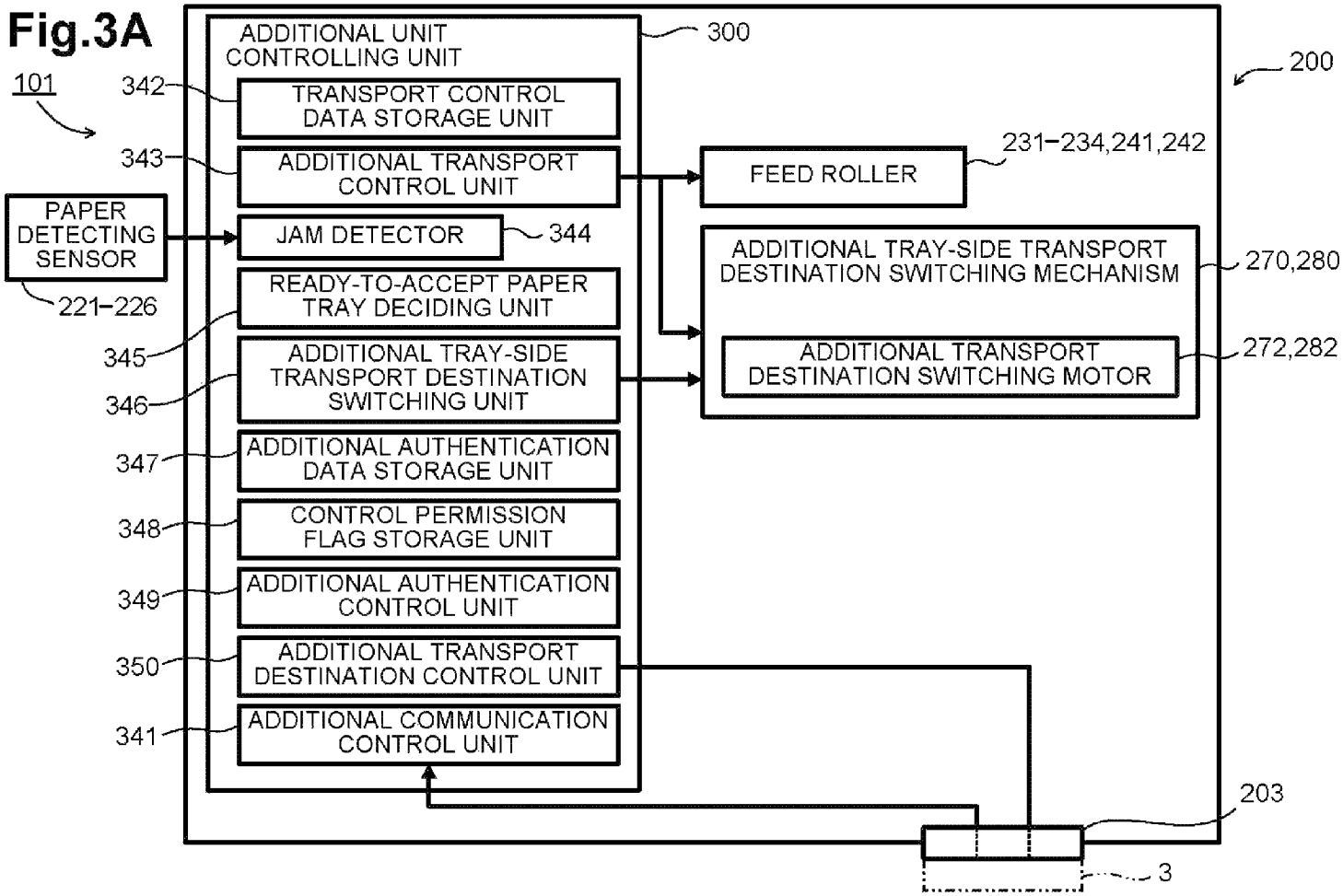
FIG. 3A and FIG. 3B are block diagrams that depict the electrical structure of the printer in FIG. 1.
Figure 3B:
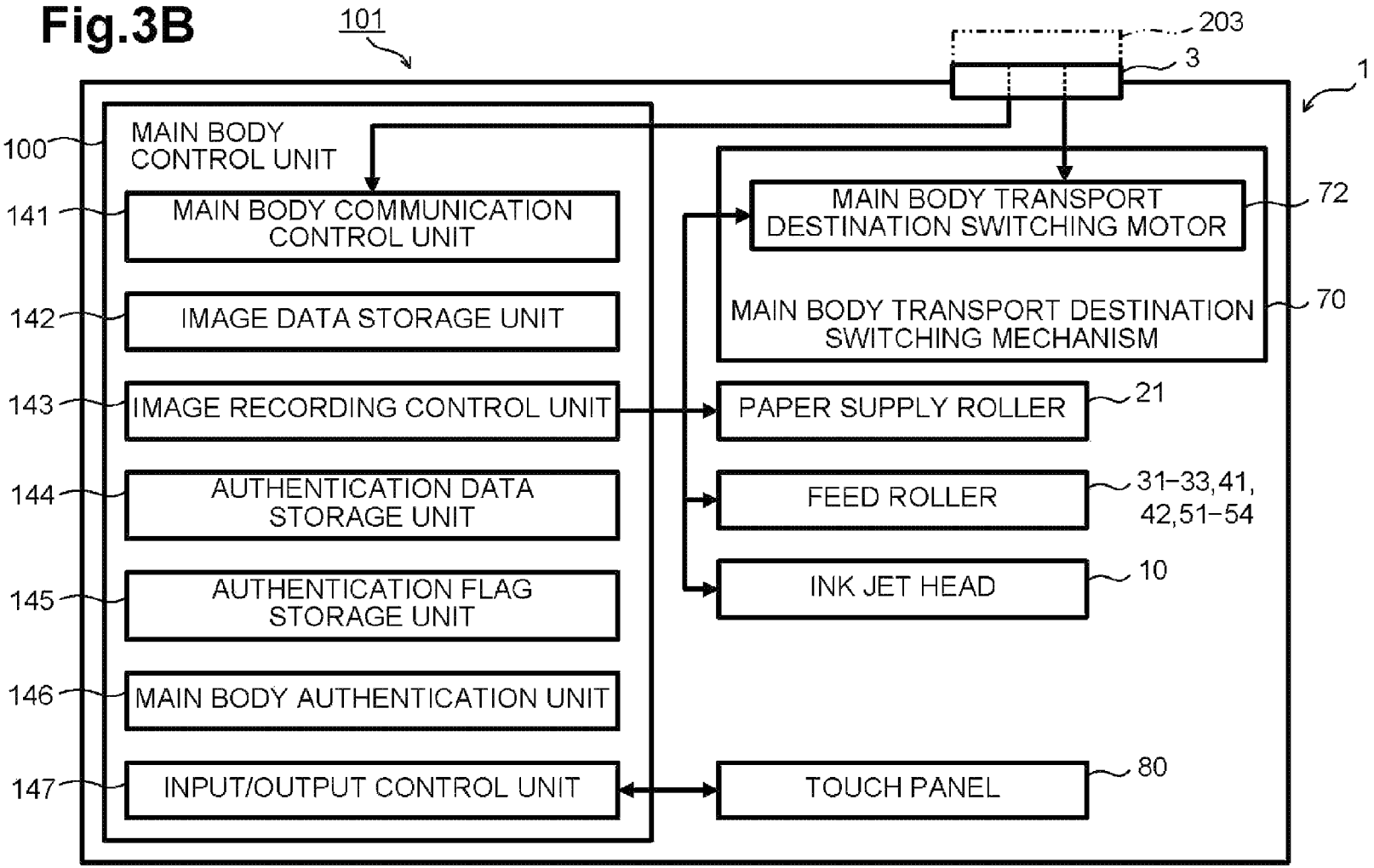

Next, main body control unit 100 of main body 1 is described with reference to FIG. 3B. Main body control unit 100 may comprise a central processing unit ("CPU"), a read-only memory ("ROM") that may store programs that may executed by the CPU and data that may be used by those programs, and random access memory ("RAM") that temporarily may store data during program execution. The functional parts of main body control unit 100 may be implemented by cooperating with software in the ROM. As depicted in FIG. 3B, main body control unit 100 further may comprise main body communication control unit 141, image data storage unit 142, image recording control unit 143, authentication data storage unit 144, authentication flag storage unit 145, main body authentication unit 146, and input/output control unit 147. In addition, main body control unit 100 may comprise an Application Specific Integrated Circuit ("ASIC") or a Field-Programmable Gate Array ("FPGA").

Main body communication control unit 141 may transmit and receive various types of data to and from additional paper output unit 200 through main body connector 3 and additional connector 203. Image data storage unit 142 may store image data and transport destination data, which may be provided as part of a recording command, which may be received from an external device. The transport destination data may indicate a transport destination to which to direct paper P, which may have an image recorded on it.

During image recording, image recording control unit 143 may control paper supply roller 21, feed rollers 31-33, 41, 42, and 51-54, and main body transport destination switching mechanism 70 (e.g., main body transport destination switching motor 72) according to the transport destination data stored in image data storage unit 142, such that paper P may be transported at a predetermined speed in the transport direction. Image recording control unit 143 may control paper supply roller 21 to feed out paper P from paper supply tray 20, so that the distance between two successive sheets of paper P transported by feed rollers 31-33, 41, 42, and 51-54 may have an inter-transport distance (e.g., a distance between the two successive sheets of paper P) slightly longer than the distance along the transport path from paper detecting sensor 221 to the branch point between main body transport path R3 and main body transport path R4. The inter-transport distance may be obtained by multiplying a time, measured from when a paper jam occurs at the upstream end of main additional transport path R5 in the transport direction until additional unit controlling unit 300 controls main body transport destination switching mechanism 70 (e.g., a time equal to a transport error), by the transport speed of paper P and adding the result to the distance along the transport path from paper detecting sensor 221 to the branch point between main body transport path R3 and main body transport path R4. Thus, when additional unit controlling unit 300 detects a paper jam on main additional transport path R5 according to the detection result of paper detecting sensor 221 disposed at the upstream end of main additional transport path R5 in the transport direction, the front end of the next successive sheet of paper P transported after the jammed sheet of paper P may be prevented from reaching the branch point between main body transport path R3 and main body transport path R4. For example, when detecting a paper jam on additional transport path RE, additional unit controlling unit 300 may transport the next sheet of paper P following the sheet of paper P jammed on additional transport path RE to main body paper output tray 60 by controlling main body transport destination switching mechanism 70 to place swinging member 71 at the first position.

Image recording control unit 143 may control head 10, so that ink may be expelled toward the transported paper P during image recording according to the image data stored in image data storage unit 142. When the transport destination data stored in image recording control unit 143 corresponds to the first additional paper output tray 261, to the first additional paper output tray 261, or to the third additional paper output tray 263, the main body communication control unit 141 may send transport control data including transport destination data to the additional paper output unit 200.

Authentication data storage unit 144 may pre-store authentication data that may be used for additional paper output unit 200 and that may be configured to permit control of main body transport destination switching mechanism 70. Authentication flag storage unit 145 may store an authentication flag that may be configured to indicate whether additional paper output unit 200 attached to main body 1 is permitted to control main body transport destination switching mechanism 70. When the authentication flag is turned on, control of main body transport destination switching mechanism 70 may be permitted. When the authentication flag is turned off, control of main body transport destination switching mechanism 70 may not be permitted.

Main body authentication unit 146 may perform authentication of a control permission that may be used by additional paper output unit 200 to control main body transport destination switching mechanism 70 to switch the transport destination between additional paper output unit 200 and main body control unit 100. For example, main body authentication unit 146 may receive authentication data, which was sent from additional paper output unit 200 through main body communication control unit 141, and then may determine for authentication whether the received authentication data matches the authentication data pre-stored in authentication data storage unit 144. When authentication succeeds (e.g., a match is found between the received authentication data and the authentication data pre-stored in authentication data storage unit 144), main body authentication unit 146 may turn on the authentication flag in authentication flag storage unit 145. When authentication fails, main body authentication unit 146 may turn off the authentication flag in authentication flag storage unit 145. Main body communication control unit 141 may send authentication result data indicating the authentication result to additional paper output unit 200.

Input/output control unit 147 may create display data to be displayed on touch panel 80 and may display the display data on touch panel 80. Input/output control unit 147 may receive manipulation inputs from the user through touch panel 80. In the embodiment depicted in FIGS. 1 and 2, touch panel 180 may comprise a display unit and a manipulation input unit.

4. Electric Structure of Additional Paper Output Unit

Next, additional unit controlling unit 300 of additional paper output unit 200 is described with reference to FIG. 3A. Additional unit controlling unit 300 may comprise a CPU, a ROM that may store programs that may be executed by the CPU and data that may be used by those programs, and a RAM that temporarily may store data during program execution. The functional parts of additional unit controlling unit 300 may be implemented by cooperating with software in the ROM. As depicted in FIG. 3A, additional unit controlling unit 300 further may comprise additional communication control unit 341 (e.g., a detection data transmission unit), transport control data storage unit 342, additional transport control unit 343, jam detector 344, ready-to-accept paper tray deciding unit 345, additional tray-side transport destination switching unit 346, additional authentication data storage unit 347, control permission flag storage unit 348, additional authentication control unit 349, and additional transport destination control unit 350. In addition, additional unit controlling unit 300 may comprise an ASIC or an FPGA.

Additional communication control unit 341 may transmit and receive various types of data to and from main body 1 through main body connector 3 and additional connector 203. When jam detector 344 detects a paper jam on main body transport path R5, for example, additional communication control unit 341 may send jam detection data to main body 1. First jam detection data may sent to main body 1 when paper P cannot be output to any of additional paper output trays 260 attached to additional paper output unit 200, and second jam detection data may be sent to main body 1, when there is an additional paper output tray 260 to which paper P may be output.

Transport control data storage unit 342 may receive and store transport control data, which may be sent from main body 1 through additional communication control unit 341. The transport control data may comprise transport destination data that may indicate whether to transport paper P to first additional paper output tray 261, to second additional paper output tray 262, or to third additional paper output tray 263.

Additional transport control unit 343 may control feed rollers 231-234, 241, and 242 and additional tray-side transport destination switching mechanisms 270 and 280, such that a sheet of paper P that was transported from main body 1 may be directed to first additional paper output tray 261, second additional paper output tray 262, or third additional paper output tray 263, as may be indicated by the transport control data that may be stored in transport control data storage unit 342. For example, when transporting paper P to first additional paper output tray 261, additional transport control unit 343 may control additional tray-side transport destination switching mechanisms 270 and 280, so that swinging members 271 and 281 may be placed at the first position. When transporting paper P to second additional paper output tray 262, additional transport control unit 343 may control additional tray-side transport destination switching mechanisms 270 and 280, so that swinging member 271 may be placed at the second position and swinging member 281 may be placed at the first position. When transporting paper P to third additional paper output tray 263, additional transport control unit 343 may control additional tray-side transport destination switching mechanism 280, so that swinging member 281 may be placed at the second position.

Jam detector 344 may detect a paper jam on additional transport path RE according to paper detection signals that may be output from paper detecting sensors 221-226 and that may identify the location of the paper jam. For example, when a paper detecting sensor 222, 223, 224, 225, or 226 (e.g., a first paper detecting sensor) does not detect the rear edge of paper P within a predetermined time after a preceding paper detecting sensor 221, 223, 224, 225, or 226 (e.g., a second paper detecting sensor) detected the front edge of paper P, jam detector 344 may determine that paper P jammed on additional transport path RE. Jam detector 344 then may identify the location at which a preceding paper detecting sensor 221, 223, 224, 225, or 226 did not detect the rear edge of paper P. Jam detector also may identify the paper jam location as the transport path R4, R5, R6, or R7 between that paper detecting sensor 221, 223, 224, 225, or 226 (e.g., a first paper detecting sensor) and the next paper detecting sensor 222, 223, 224, 225, or 226 disposed upstream in the transport direction (e.g., a second paper detecting sensor). For example, when paper detecting sensor 221 detects the rear edge of paper P, but paper detecting sensors 224 and 226 do not detect the rear edge of paper P, jam detector 344 may identify main additional transport path R5 and branch additional transport path R7 as the paper jam locations based on the location of paper detecting sensor 221 (e.g., at paper supply opening 200*d* at the upstream end of main additional transport path R5) and paper detecting sensor 224 (e.g., at the branch point of branch additional transport path R7). Similarly, when paper detecting sensors 221 and 224 detect the read edge of paper P, but paper detecting sensor 226 does not detect the rear edge of paper P, jam detector 344 may identify branch additional transport path R7 as the paper jam location. In the embodiment depicted in FIGS. 1 and 2, paper detecting sensors 221-226 and jam detector 344 may function as a paper jam detecting unit.

The ready-to-accept paper tray deciding unit 345 may determine whether there may be an additional paper output tray 260, to which paper P may be output. When determining whether there may be an additional paper output tray 260, to which paper P may be output, ready-to-accept paper tray deciding unit 345 may store the identity of the additional paper output tray(s) 260 to which paper P may be output. For example, ready-to-accept paper tray deciding unit 345 may determine whether paper P may be output any of the paths from paper supply opening 200*d* to first additional paper output tray 261, to second additional paper output tray 262, or to third additional paper output tray 263 based on the paper jam location identified by jam detector 344. When there is no paper jam on the path from paper supply opening 200*d* to an additional paper output tray 260, ready-to-accept paper tray deciding unit 345 may determine that there is an additional paper output tray 260 to which paper P may be output, and may store the identity of that additional paper output tray 260. When jam detector 344 identifies the paper jam location as the main additional transport path R5 from paper supply opening 200*d* to the branch point of branch additional transport path R7, all paths from paper supply opening 200*d* to first additional paper output tray 261, to second additional paper output tray 262, and to third additional paper output tray 263 may be identified by jam detector 344 as being jammed. In that example, ready-to-accept paper tray deciding unit 345 may determine that there is no additional paper output tray 260, to which paper P may be output. In contrast, when jam detector 344 identifies main additional transport path R5 as not jammed and identifies branch additional transport path R7 as the paper jam location, which indicates that the path from paper supply opening 200*d* to first additional paper output tray 261 and the path from paper supply opening 200*d* to second additional paper output tray 262 are not jammed, ready-to-accept paper tray deciding unit 345 may determine that paper P may be output to first additional paper output tray 261 and second additional paper output tray 262.

When jam detector 344 detects a paper jam, and when ready-to-accept paper tray deciding unit 345 determines that there are additional paper output trays 260, to which paper P may be output, additional tray-side transport destination switching unit 346 may control additional tray-side transport destination switching mechanisms 270 and 280, so that a sheet of paper P that was transported from main body 1 may be directed to a additional paper output tray 260 that has its identity stored in ready-to-accept paper tray deciding unit 345.

Additional authentication data storage unit 347 may pre-store authentication data specific to additional paper output unit 200, which may be used in authentications between main body 1 and additional paper output unit 200. Control permission flag storage unit 348 may store a control permission flag that may be configured to indicate whether to permit additional transport destination control unit 350 to control main body transport destination switching mechanism 70. When the control permission flag is turned on, additional transport destination control unit 350 may be permitted to control main body transport destination switching mechanism 70. When the control permission flag is turned off, additional transport destination control unit 350 may not be permitted to control main body transport destination switching mechanism 70.

Additional authentication control unit 349 may perform authentication of control permission that may be used by additional paper output unit 200 to control main body transport destination switching mechanism 70 to switch the transport destination between additional paper output unit 200 and main body control unit 100. For example, when additional paper output unit 200 is attached to main body 1, additional authentication control unit 349 may send the authentication data pre-stored in additional authentication data storage unit 347 to main body 1 through additional communication control unit 341. Additional authentication control unit 349 then may receive authentication result data, which may be sent from main body 1 through additional communication control unit 341. When the received authentication data indicates that authentication succeeded, additional authentication control unit 349 may turn on the control permission flag that may be stored in control permission flag storage unit 348. When the received authentication data indicates that authentication failed, additional authentication control unit 349 may turn off the control permission flag that may be stored in control permission flag storage unit 348. In the embodiment depicted in FIGS. 1 and 2, control permission flag storage unit 348 and additional authentication control unit 349 may function as a control permission unit.

When jam detector 344 detects a paper jam, when ready-to-accept paper tray deciding unit 345 determines that there is no additional paper output tray 260 to which paper P may be output, and, when the control permission flag stored in control permission flag storage unit 348 is turned on, additional transport destination control unit 350 may directly control main body transport destination switching mechanism 70 of main body 1 to drive main body transport destination switching mechanism 70 so as to switch the transport destination of paper P from additional paper output unit 200 to main body paper output tray 60.

5. Operation of Main Body

Figure 4:
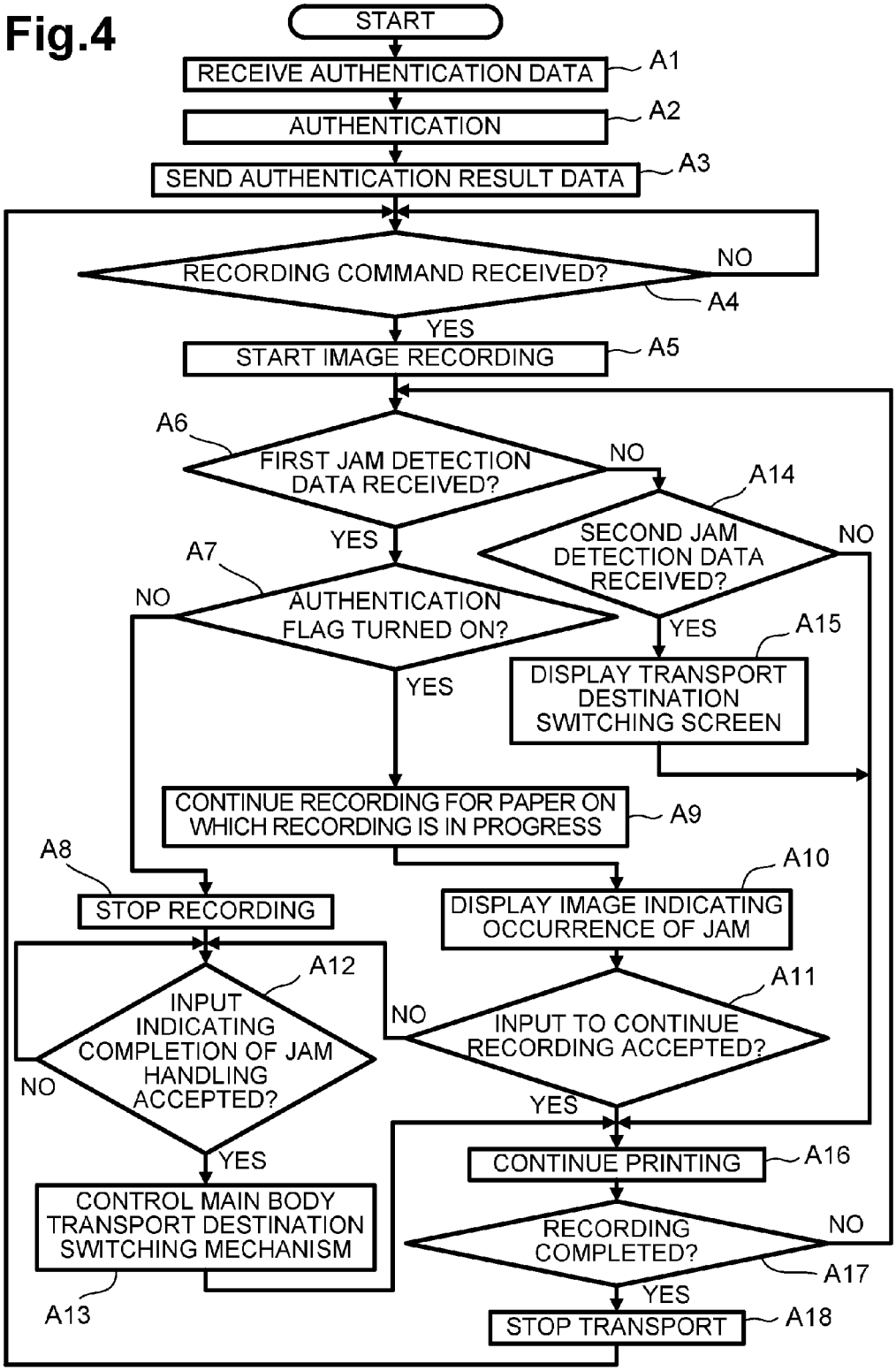
FIG. 4 is a flowchart that depicts the operation of the printer in FIG. 1.

Next, the operation of main body 1 is described with reference to FIG. 4. The flowchart depicted in FIG. 4 starts before additional paper output unit 200 is attached to main body 1.

First, when additional paper output unit 200 is attached to main body 1, main body communication control unit 141 may receive authentication data sent from additional paper output unit 200 at Step A1. Main body authentication unit 146 then may determine whether there is a match between the authentication data sent from additional paper output unit 200 and the authentication data pre-stored in authentication data storage unit 144 at Step A2. Main body authentication unit 146 may send authentication result data indicating the authentication result to additional paper output unit 200 through main body communication control unit 141 and may update the authentication flag stored in authentication flag storage unit 145 according to the authentication result at Step A3. When authentication by the main body authentication unit 146 succeeds, main body authentication unit 146 may turn on the authentication flag stored in authentication flag storage unit 145.

Next, main body control unit 100 may determine whether a recording command was received from an external device at Step A4. When main body control unit 100 determines that a recording command was not received (e.g., the result in Step A4 is NO), Step A4 may be repeated periodically until a recording command is received. When main body control unit 100 determines that a recording command was received (e.g., the result in Step A4 is YES), image recording control unit 143 may control paper supply roller 21, toed rollers 31-33, 41, 42, and 51-54, main body transport destination switching mechanism 70 (e.g., main body transport destination switching motor 72), and head 10 and may start to record an image on paper P according to the image data stored in image data storage unit 142 at Step A5. When the transport destination data stored in image data storage unit 142 indicates that paper P is to be output to main body paper output tray 60, image recording control unit 143 may control main body transport destination switching mechanism 70, so that swinging member 71 is placed at the first position. When the transport destination data indicates that paper P is to be output to first additional paper output tray 261, to second additional paper output tray 262, or to third additional paper output tray 263, image recording control unit 143 may control main body transport destination switching mechanism 70, so that swinging member 71 is placed at the second position and may send the transport control data to additional paper output unit 200 through main body communication control unit 141. In the description that follows, the transport control data provided as part of the recording command received from the external device may be assumed to indicate that paper P is to be output to first additional paper output tray 261, to second additional paper output tray 262, or to third additional paper output tray 263.

Next, main body control unit 100 may determine whether main body communication control unit 141 received the first jam detection data from additional paper output unit 200 at Step A6. When main body control unit 100 determines that the first jam detection data was received (e.g., the result in Step A6 is YES), main body control unit 100 may determine whether the authentication flag stored in authentication flag storage unit 145 is turned on at Step A7. When main body control unit 100 determines that the authentication flag is not turned on (e.g., the result in Step A7 is NO), it may be determined that main body transport destination switching mechanism 70 may not be controlled by additional paper output unit 200. For example, swinging member 71 may be placed at the first position, such that image recording control unit 143 may control paper supply roller 21 and feed rollers 31-33, 41, 42, and 51-54 and may stop the transport of paper P and the expelling of ink from head 10 (e.g., a recording operation) to prevent the paper jam from spreading at Step A8. Upon completion of Step A8, the processing may proceed to Step A12.

When main body control unit 100 determines in Step A7 that the authentication flag is turned on (e.g., the result in Step A7 is YES), image recording control unit 143 may control paper supply roller 21, feed rollers 31-33, 41, 42, and 51-54, and head 10 at Step A9, so as to continue a recording operation on a current sheet of paper P, and to stop the recording operation for subsequent sheets of paper P that may be fed out of paper supply tray 20 after the current sheet of paper P for which the recording operation is currently in progress. In that example, because swinging member 71 may be placed at the second position by additional paper output unit 200, the current sheet of paper P on which a recording operation is currently in progress may be transported to main body paper output tray 60.

After Step A9 is executed, input/output control unit 147 may displays, on touch panel 80, an image indicating that paper P jammed on an additional transport path of additional paper output unit 200, an image indicating that the transport destination of paper P was switched to main body paper output tray 60, and a selection image that prompts the user to select whether to continue a recording operation on paper P using main body paper output tray 60 as the transport destination of paper P at Step A10. Accordingly, a user may visually confirm that the transport destination of paper P was switched to main body paper output tray 60 because paper P jammed on additional transport path RE in additional paper output unit 200.

Next, input/output control unit 147 may determine whether input was received through manipulation of touch panel 80 at Step A11 to select that a recording operation on paper P be continued. When input/output control unit 147 determines from the input that a selection was made to cancel a recording operation on paper P the result in Step A11 is NO), the processing may proceed to Step A12. When input/output control unit 147 determines from the input that a selection was made to continue a recording operation on paper P (e.g., the result in Step A11 is YES), the processing may proceed to Step A16.

In Step A12, it may be determined whether input/output control unit 147 received input through manipulation of touch panel 80 to confirm that a paper jam was cleared. To clear a paper jam, for example, door 200*c* may be opened and the jammed sheet of paper P may be removed from additional transport path RE. When it is determined in Step A12 that input/output control unit 147 did not receive input confirming that the paper jam was cleared (e.g., the result in Step A12 is NO). Step A12 may be repeated until the paper jam is cleared and input/output control unit 147 receives input confirming that the paper jam was cleared. When it is determined that input/output control unit 147 received input confirming that the paper jam was cleared (e.g., the result in Step A12 is YES), image recording control unit 143 may control main body transport destination switching mechanism 70 (e.g., main body transport destination switching motor 72), so that paper P may be transported to the transport destination indicated by the transport destination data stored in image data storage unit 142 at Step A13, after which the processing may proceed to Step A16.

When it is determined in Step A6 that main body communication control unit 141 did not receive the first jam detection data (e.g., the result in Step A6 is NO), it may be determined whether main body communication control unit 141 received the second jam detection data indicating that the transport destination has switched to a different additional paper output tray 260 at Step A14. When it is determined that main body communication control unit 141 did not receive the second jam detection data (e.g., the result in Step A14 is NO), the processing may proceed to Step A16. When it is determined that main body communication control unit 141 received the second jam detection data (e.g., the result in Step A14 is YES), input/output control unit 147 may display, on touch panel 80, an image indicating that the transport destination of paper P was switched to a different additional paper output tray 260 and to which additional paper output tray 260 (e.g., to first additional paper output tray 261, to second additional paper output tray 262, or to third additional paper output tray 263) the transport destination was switched at Step A15. Accordingly, a user may visually confirm that the transport destination of paper P was switched to a different additional paper output tray 260 when a sheet of paper P jams in additional transport path RE in additional paper output unit 200. Upon completion of the process in Step A15, the processing may proceed to Step A16.

In Step A16, image recording control unit 143 may control feed rollers 31-33, 41, 42, and 51-54 and head 10 so as to continue the recording on paper P according to the image data stored in image data storage unit 142. Upon completion of the process in Step A16, image recording control unit 143 may determine whether the recording of the image stored in image data storage unit 142 on paper P was completed at Step A17. When image recording control unit 143 determines that the recording of the image data on paper P was not completed (e.g., the result in Step A17 is NO), the processing may return to Step A6. When image recording control unit 143 determines that the recording of the image data on paper P was completed (e.g., the result in Step A17 is YES), image recording control unit 143 may control paper supply roller 21 and feed rollers 31-33, 41, 42, and 51-54 no as to stop the transport of paper P, and main body communication control unit 141 may send transport stopping data to additional paper output unit 200 at Step A18, after which the processing may return to Step A4. That completes the operation of main body 1.

6. Operation of Additional Paper Output Unit

Figure 5:
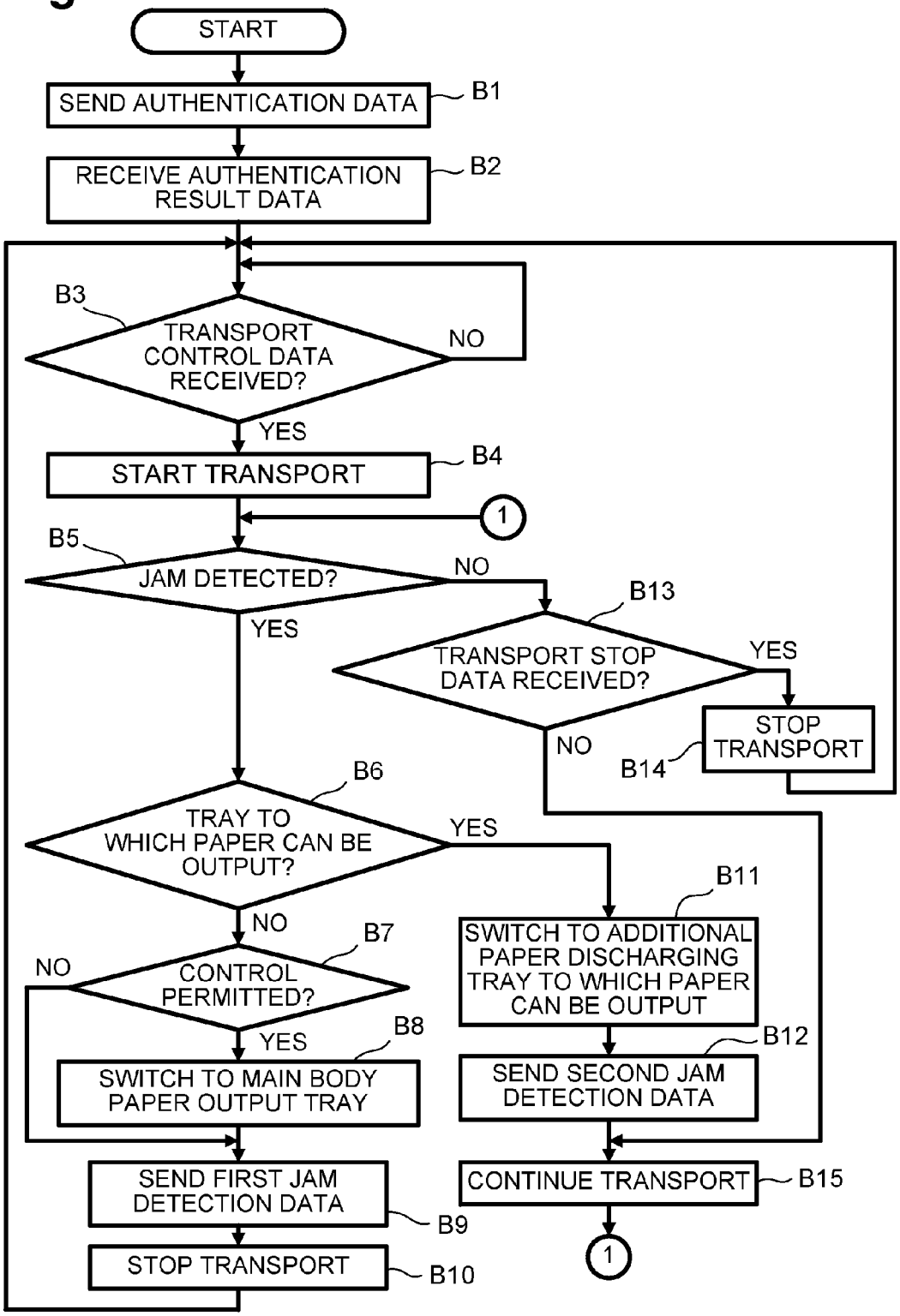
FIG. 5 is a flowchart that depicts the operation of the additional paper output unit in FIG. 1.

Next, the operation of additional paper output unit 200 is described with reference to FIG. 5. The flowchart depicted in FIG. 5 starts before additional paper output unit 200 is attached to main body 1.

First, when additional paper output unit 200 is attached to main body 1, additional authentication control unit 349 may send authentication data pre-stored in additional authentication data storage unit 347 to main body 1 through additional communication control unit 341 at Step B1. Additional authentication control unit 349 then may receive the authentication data, which may be sent from main body 1, through additional communication control unit 341 and may update the control permission flag in control permission flag storage unit 348 according to the received authentication data at Step B2. When the authentication by main body authentication unit 146 succeeds, additional authentication control unit 349 may turn on the authentication flag stored in control permission flag storage unit 348.

Next, main body communication control unit 141 may determine whether transport control data was received from main body 1 at Step B3. When main body communication control unit 141 determines that transport control data was not received (e.g., the result in Step B3 is NO), Step B3 may be repeated to wait until transport control data is received. When main body communication control unit 141 determines that transport control data was received (e.g., the result in Step B3 is YES), transport control data storage unit 342 may store the transport control data. Then, to start a transport operation, additional unit controlling unit 300 may control feed rollers 231-234, 241, and 242 and additional tray-side transport destination switching mechanisms 270 and 280 (e.g., additional transport destination switching motors 272 and 282) according to the received transport control data, so that paper P may be transported at Step B4.

Next, at Step B5, it may be determined whether jam detector 344 detected a paper jam. When it is determined that jam detector 344 detected a paper jam (e.g., the result in Step B5 is YES), ready-to-accept paper tray deciding unit 345 may determine whether there may be an additional paper output tray 260 to which paper P may be output at Step B6. When ready-to-accept paper tray deciding unit 345 determines that there is no additional paper output tray 260 to which paper P may be output (e.g., the result in Step B6 is NO), additional transport destination control unit 350 may determine whether the control permission flag stored in control permission flag storage unit 348 is turned on at Step B7. When additional transport destination control unit 350 determines that the control permission flag is not turned on (e.g., the result in Step B7 is NO), the processing may proceed to Step B9. When additional transport destination control unit 350 determines that the control permission flag is turned on (e.g., the result in Step B7 is YES), additional transport destination control unit 350 may control main body transport destination switching mechanism 70 (e.g., main body transport destination switching motor 72), so that the transport destination of paper P may be switched from additional paper output unit 200 to main body paper output tray 60 at Step B8. For example, additional transport destination control unit 350 may drive main body transport destination switching motor 72 to place swinging member 71 at the first position. Upon completion of the process in Step B8, the processing may proceed to Step B9.

In Step B9, additional communication control unit 341 may send the first jam detection data to main body 1. Additional transport destination control unit 350 then may control feed rollers 231-234, 241, and 242 at Step B10, so that the transport of paper P may be stopped, and the processing may return to Step B3.

When ready-to-accept paper tray deciding unit 345 determines in Step 86 that there may be an additional paper output tray 260 to which paper P may be output (e.g., the result in Step B6 is YES), additional tray-side transport destination switching unit 346 may control additional tray-side transport destination switching mechanisms 270 and 280 (e.g., additional transport destination switching motors 272 and 282), so that, at Step B11, the transport destination of paper P may be switched to an additional paper output tray 260 to which paper P may be directed. Thus, a paper jam in additional paper output unit 200 may be prevented from spreading without controlling main body transport destination switching mechanism 70 in main body 1. Next, additional communication control unit 341 may send to main body 1, as a new transport destination, the second jam detection data that may comprise data indicating to which additional paper output tray 260 the additional tray-side transport destination switching unit 346 was switched at Step B12, after which the processing may proceed to Step B15.

When it is determined in Step B5 that jam detector 344 did not detect a paper jam (e.g., the result in Step B5 is NO), it may be determined whether additional communication control unit 341 received transport stopping data at Step B13. When it is determined that additional communication control unit 341 did not receive transport stopping data (e.g., the result in Step B13 is NO), the processing may proceed to Step B15. When it is determined that additional communication control unit 341 did receive transport stopping data (e.g., the result in Step B13 is YES), feed rollers 231-234, 241, and 242 may be controlled, so that the transport of paper P may be stopped at Step B14, after which the processing may return to Step B3.

In Step B15, feed rollers 231-234, 241, and 242 may be controlled, so that the transport of paper P may be continued. Upon completion of Step B15, the processing may return to Step B5, which completes the operation of additional paper output unit 200.

As described above, because additional transport destination control unit 350 in printer 101 may directly control main body transport destination switching mechanism 70 in main body 1, it is possible to reduce the processing time taken from when paper P jams in additional paper output unit 200 until the transport destination of paper P is switched to main body paper output tray 60. As a result, the spreading of a paper jam in additional paper output unit 200 may be prevented.

As also described above, when a paper jam occurs in additional paper output unit 200, recording may be continued only on a current sheet of paper P, on which a recording operation is currently in progress, such that it is possible to prevent that current sheet of paper P from being wasted and the number of sheets of paper P that are output to main body paper output tray 60, instead of the original output destination, is minimized. Further, because additional transport destination control unit 350 may control main body transport destination switching mechanism 70, when the control permission for additional paper output unit 200 to control main body transport destination switching mechanism 70 is authenticated successfully between main body control unit 100 and additional paper output unit 200, control of main body transport destination switching mechanism 70 may be carried out normally.

In the embodiments depicted in FIGS. 1-5, when any of paper detecting sensors 222, 223, 224, 225, or 226 does not detect the rear edge of paper P within the predetermined time after paper detecting sensor 221, 223, 224, 225, or 226 detected the front edge of paper P, jam detector 344 may determine that a paper jam occurred on additional transport path RE. Nevertheless, the invention is not so limited. For example, when a paper detecting sensor 222, 223, 224, 225, or 226 disposed downstream in the transport direction (e.g., a first paper detecting sensor) does not detect the front edge of paper P within a predetermined time alter a paper detecting sensor 221, 223, 224, 225, or 226 disposed upstream in the transport direction (e.g., a second paper detecting sensor) detected the front edge of paper P, the end of which may be a time at which the paper detecting sensor 222, 223, 224, 225, or 226 disposed downstream in the transport direction was predicted to detect the front edge of paper P, a paper jam may be determined to have occurred on additional transport path RE. In that example, the predetermined time may be obtained by dividing the distance between the first paper detecting sensor and the second paper detecting sensor along the transport path by the transport speed of paper P and adding the result to a time equal to a transport error.

In the embodiments depicted in FIGS. 1-5, during the authentication of control permission for additional paper output unit 200 to control main body transport destination switching mechanism 70, additional unit controlling unit 300 may send authentication data to main body control unit 100, and main body control unit 100 may determine whether there may be a match between the sent authentication data and the authentication data pre-stored in main body 1. Again, the invention is not so limited. For example, main body control unit 100 also may send the authentication data to additional unit controlling unit 300, and additional unit controlling unit 300 may determine whether there may be a match between the sent authentication data and the authentication data pre-stored in additional paper output unit 200. In that example, additional paper output unit 200 may be authenticated. Nevertheless, an arrangement in which additional paper output unit 200 is not authenticated also may be used.

In the embodiments depicted in FIGS. 1-5, when a paper jam occurs on additional transport path RE in additional paper output unit 200, and when paper P is output to another additional paper output tray 260, a recording operation may be continued on subsequent sheets of paper P after a current sheet of paper P on which the recording operation is currently in progress, without receiving input to confirm that the printing operation is to proceed. Yet again, the invention is not so limited. For example, the recording operation may be continued on the current sheet of paper P, but the recording operation may be stopped on subsequent sheets of paper P, with or without receiving input to confirm that the printing operation is to be stopped.

In the embodiments depicted in FIGS. 1-5, the image recording unit (e.g., head 10 and the like) may be controlled by main body control unit 100. Nevertheless, the image recording unit also may be controlled by additional unit controlling unit 300. When additional unit controlling unit 300 directly controls the image recording unit and the main body transport section, and jam detector 344 detects a paper jam, it is possible to minimize further the number of sheets of paper P, which are output to main body paper output tray 60, instead of the original output destination.

In the embodiments depicted in FIGS. 1-5, image recording control unit 143 may control paper supply roller 21 to feed out paper P from paper supply tray 20, so that the distance between two successive sheets of paper P transported by feed rollers 31-33, 41, 42, and 51-54 becomes an inter-transport distance somewhat greater than the distance along the transport path from paper detecting sensor 221 to the branch point between main body transport path R3 and main body transport path R4. Nevertheless, sheets of paper P also may be fed out from paper supply tray 20, so that the distance between two successive sheets of paper P is reduced to less than the inter-transport distance. In that example, however, the next sheet of paper P transported after the jammed paper P is likely to jam, but subsequent sheets of paper P after that next sheet of paper P still may be prevented from jamming.

In addition, although transport mechanism 30 and additional transport mechanism 230 may be formed with feed rollers and guides in the embodiments depicted in FIGS. 1-5, the invention is not so limited. For example, transport mechanism 30 and additional transport mechanism 230 also may be formed with a transport belt. The present invention also may be applied to a facsimile machine, a copying machine, and the like without being limited to a printer. The head may expel any liquid other than an ink. Two or more heads may be provided in printer 101. Head 10 (e.g., an image recording unit) may be a line-type inkjet head or a serial-type inkjet head. Further, the image recording unit may record by electrophotographic laser head(s). Moreover, the recording medium is not limited to paper P; it may be any medium on which printing is possible.

While the invention is described above in connection with various example structures and illustrative embodiments, it will be understood by those skilled in the art that other variations and modifications of the structures, configurations, and embodiments described above may be made without departing from the scope of the invention. For example, this application comprises any possible combination of the various elements and features disclosed herein, and the particular elements and features presented in the claims and disclosed above may be combined with each other in other ways within the scope of the application, such that the application should be recognized as also directed to other embodiments comprising any other possible combinations. Other structures, configurations, and embodiments will be apparent to those skilled in the art from a consideration of the specification or practice of the invention disclosed herein. It is intended that the specification and the described examples are illustrative, with the true scope of the invention being defined by the following claims.

What is claimed is:

1. A recording system comprising an image recording apparatus and an additional output stacker attached, wherein:

the image recording apparatus comprises:

an apparatus-side transport unit configured to transport a recording medium, an image recording unit configured to record an image on the recording medium according to image data, an apparatus-side output tray configured to receive the recording medium, a transport destination switching unit configured to switch selectively a transport destination of the recording medium between the apparatus-side output tray and the additional output stacker, such that the recording medium, on which the image has been recorded by the image recording unit, is directed either to the apparatus-side output tray or to the additional output stacker, and an apparatus-side controller configured to control the apparatus-side transport unit, the image recording unit, and the transport destination switching unit; and the additional output stacker is configured to attach to the image recording apparatus and comprises:

an additional output tray configured to receive the recording medium, a stacker-side transport unit configured to transport the recording medium to the additional output tray, when the recording medium is directed to the additional output stacker by the transport destination switching unit, a jam detecting unit configured to detect a recording medium jam generated in the stacker-side transport unit, and a stacker-side controller configured to control the transport destination switching unit of the image recording apparatus, so that, when the jam detecting unit detects the recording medium jam, the transport destination switching unit switches the transport destination of the recording medium from the additional output stacker to the apparatus-side output tray.

2. The recording system according to claim 1, wherein:

the additional output stacker comprises a plurality of additional output trays;

the stacker-side transport unit comprises:

a stacker-side main transport section configured to transport the recording medium to a first additional output tray of the plurality of additional output trays; and a stacker-side branch transport section configured to branch the recording medium from the stacker-side main transport section and to transport the recording medium to a second additional output tray; and the stacker-side controller is configured to control the transport destination switching unit, so that, when the jam detecting unit detects that the recording medium jam is in the stacker-side main transport section and is present upstream of a branch point between the stacker-side main transport section and the stacker-side branch transport section in a transport direction, the transport destination of the recording medium is switched from the additional output stacker to the apparatus-side output tray.

3. The recording system according to claim 2, wherein the additional output stacker further comprises:

a stacker-side transport destination switching unit configured to selectively switch the transport destination of the recording medium, which has been transported from the image recording apparatus, between at least between the first additional output tray and the second additional output tray, and a stacker-side controller configured to control the stacker-side transport destination switching unit, so that, when the jam detecting unit has detected the recording medium jam on the stacker-side branch transport section and has not detected a recording medium jam on the stacker-side main transport section, the transport destination of the recording medium is switched from the second additional output tray to the first additional output tray.

4. The recording system according to claim 1, wherein:

the additional output stacker further comprises a detection data transmitting unit configured to transmit jam detection data to the apparatus-side controller when the jam detecting unit detects the recording medium jam; and upon receipt of the jam detection data from the jam detecting unit, the apparatus-side controller is configured to control the image recording unit so as to continue a recording currently in progress on the recording medium and cancel a recording on subsequent recording medium.

5. The recording system according to claim 4, wherein:

the image recording apparatus further comprises a display device and an input device configured to receive input via manual manipulation;

when the apparatus-side controller receives the jam detection data from the detection data transmitting unit, the apparatus-side controller is configured to display an image on the display unit that:

indicates that a recording medium jam has occurred on the stacker-side transport unit in the additional output stacker, indicates that the transport destination of the recording medium has been switched to the apparatus-side output tray, and prompts the selection of whether to continue recording on the recording medium by using the apparatus-side output tray as the transport destination of the recording medium; and the apparatus-side controller is further configured to control the image recording unit so as to continue the recording on the recording medium, when the input device receives input via manual manipulation to continue the recording on the recording medium.

6. The recording system according to claim 1, wherein the apparatus-side controller is further configured to:

perform authentication of a control permission used by the stacker-side controller to control the transport destination switching unit from the additional output stacker via the apparatus-side controller;

permit the stacker-side controller to control the transport destination switching unit when authentication of the control permission succeeds; and prevent the stacker-side controller from controlling the transport destination switching unit when authentication of the control permission fails.

7. An additional output stacker configured to be attached to an image recording apparatus comprising a apparatus-side output tray and a transport destination switching unit configured to selectively switch a transport destination of a recording medium between the apparatus-side output tray and a location other than the apparatus-side output tray, the additional output stacker comprising:

an additional output tray configured to receive the recording medium at the location other than the apparatus-side output tray;

a transport unit configured to transport the recording medium to the additional output tray, when the transport destination switching unit has set the transport destination of the recording medium to the location other than the apparatus-side output tray;

a jam detecting unit configured to detect a recording medium jam generated on the transport unit; and a controller configured to control the transport destination switching unit of the image recording apparatus, so that, when the jam detecting unit detects the recording medium jam, the transport destination of the recording medium is switched from the location other than the apparatus-side output tray to the apparatus-side output tray.

* * * * *